US007852210B2

(12) United States Patent
Merritt et al.

(10) Patent No.: US 7,852,210 B2
(45) Date of Patent: Dec. 14, 2010

(54) MOTION DETECTOR FOR DETECTING TAMPERING AND METHOD FOR DETECTING TAMPERING

(75) Inventors: David E. Merritt, Rocklin, CA (US); Mark C. Buckley, Pollock Pines, CA (US)

(73) Assignee: Honeywell International Inc., Morristown, NJ (US)

( * ) Notice: Subject to any disclaimer, the term of this patent is extended or adjusted under 35 U.S.C. 154(b) by 408 days.

(21) Appl. No.: 12/140,555

(22) Filed: Jun. 17, 2008

(65) Prior Publication Data

US 2009/0167538 A1 Jul. 2, 2009

Related U.S. Application Data

(63) Continuation-in-part of application No. 11/967,761, filed on Dec. 31, 2007, now abandoned.

(51) Int. Cl.
*G08B 21/00* (2006.01)

(52) U.S. Cl. ..... 340/540; 340/541; 340/552; 340/555; 340/556; 340/557; 340/600

(58) Field of Classification Search ..... 340/540, 340/541, 552, 555, 556, 557, 600; 250/211
See application file for complete search history.

(56) References Cited

U.S. PATENT DOCUMENTS 4,451,733 A * 5/1984 Avery et al. ..... 250/342
6,351,234 B1 2/2002 Choy
6,529,129 B1 * 3/2003 Tomooka ..... 340/556
7,004,784 B2 * 2/2006 Castle ..... 439/489
7,170,403 B2 * 1/2007 Noguchi ..... 340/507
2008/0084292 A1 4/2008 DiPoala

FOREIGN PATENT DOCUMENTS

| | | |
|---|---|---|
| DE | 0 476 397 | 3/1992 |
| EP | 0 556 898 | 8/1999 |
| EP | 1 154 387 | 11/2001 |

OTHER PUBLICATIONS

EP Search Report for application 0954254.8 dated Oct. 15, 2009 (7 pages) for companion EP case.

* cited by examiner

*Primary Examiner*—Tai T Nguyen
(74) *Attorney, Agent, or Firm*—Husch Blackwell Welsh Katz

(57) ABSTRACT

A motion detector for detecting a tampering within a detection zone. A vibration-sensing unit sensitive to vibrations applied to the detector is provided to produce a vibration output signal representative of a detected parameter of the vibrations. A light-sensing unit sensitive to light in a predetermined spectrum is provided to produce a light output signal representative of a detected parameter of the light in the predetermined spectrum. A processing unit is further provided to determine if the vibration output signal is consistent with a predetermined model indicative of a tampering and producing an activating signal accordingly.

15 Claims, 3 Drawing Sheets

MOTION DETECTOR FOR DETECTING TAMPERING AND METHOD FOR DETECTING TAMPERING

CROSS REFERENCE TO RELATED APPLICATIONS

The present application is a continuation in part application of U.S. Ser. No. 11/967,761, filed Dec. 31, 2007, the entire contents of which are incorporated herein by reference.

FIELD OF THE INVENTION

The present invention relates generally to sensors and security systems. More particularly, the present invention relates to a detector that includes a sensing element adapted for detecting vibration signals generated upon the tampering of the detector.

BACKGROUND

Sensors are used to detect events such as a glass break, motion, asset movement, temperature and impact/shock. These sensors can be used as a standalone device or in combination with a security system. A security system includes a life, safety, and property protection system. The sensors communicate with a control panel when the sensor detects an event.

Motion detectors contain a lens array or window/mirror array system which focuses Infrared (IR) energy produced by a human onto a pyroelectric sensor which converts the changes in IR energy reaching it into electrical signals. The energy produced by human body temperatures is in the range of 5 μM to 15 μM, also known as far IR. The lens array in one style of a motion detector and the window in another style containing a mirror array must allow far IR energy to pass in order for the energy to be focused on the pyroelectric sensor If the lens or window is tampered with in such a way to prohibit passage of far IR energy, the motion detector will fail to detect an intruder.

Motion sensors or detectors can be intentionally tampered by an intruder. For example, the intruder can mask the window or lens of the detector by a coating, such as paints. Masking of the detector prevents the IR energy from reaching the pyroelectric sensor of the detector, thereby undermining the detection functionality of detecting motion within a protected area. Generally, spraying or brushing a coating or film on the window or lens of the sensor blocking the infrared signal can mask a detector, such as a passive infrared sensor (PIR).

In light of the foregoing problems, many motion detectors are designed to include systems to detect intentional masking or blocking of the sensing element of the sensor. These systems are commonly referred to as anti-mask systems. For example, these motion detectors employ active near infrared sensors (wavelengths just beyond the visible spectrum typically around 900 nM) as their basic instrument for anti-masking. Honeywell "Viewguard PIR AM" is an example of such motion detectors using active near infrared sensing system, and is market available. In an alternate embodiment, these motion detectors may use a microwave sensing system as anti-mask systems. Honeywell DT7550 is an example of such motion detectors using microwave sensing system, and is market available.

However, these detectors have inherent weakness to paints applied with brushes tenderly or spray cans. The act of a spray application only causes a slight transient change in the active near infrared sensor signal. However, this transient change can be caused by other events not associated with masking, such as an electrical spike or a pass of an object. The act of applying clear paints via a brush generally causes significant swings in the active near infrared sensor signal. However, a fluttering moth or a feather duster can cause the same swings as the brush. Thus, detection of only transient change or swings in the detector signal is not sufficient and sometimes not reliable to detect masking, because a false alarm indicating tampering may be issued.

Furthermore, so-called clear sprayed on materials, such as hair spay or clear paint, are inherently difficult to detect. Other difficult materials are clear adhesives, such as clear tapes, applied very smoothly to the lens without wrinkles or air bubbles, which are nearly impossible to detect after the application. Clear paints and clear adhesives are transparent to visible and near IR (Infrared) energy but block far IR energy. Thus, the window of the detector covered in clear paint or adhesive blocks the thermal energy from an intruder from reaching the pyroelectric sensor, which renders the detector blind.

Therefore, it would be very advantageous to provide a motion detector and a method having an anti-mask mechanism capable of effectively and reliably detecting any possible intentional masking of the detector.

SUMMARY OF THE INVENTION

The present invention is directed to a motion detector that is capable of detecting tampering of the detector. In particularly, the detector of the invention can detect masking of the detector in the form of spraying or brushing a coating on the lens or window for the purposes of blocking far IR energy from reaching the pyroelectric sensor.

The detector includes a vibration-sensing unit sensitive to vibrations applied to the detector, which produces a vibration output signal representative of a detected parameter of the vibrations, an infrared light-sensing unit sensitive to light having wavelengths in the 5-15 micron region, which produces a light output signal representative of a detected parameter of the light in the predetermined spectrum and a processing unit for determining if the vibration output signal is consistent with a predetermined model indicative of a tampering and producing an activating signal accordingly.

The present invention is also directed to a method of detecting tampering of a motion detector. The method includes the steps of sensing vibrations applied to the detector and producing a vibration output signal representative of a detected level of the vibration, determining if the vibration output signal is consistent with a predetermined model indicative of a tampering and producing an activating signal accordingly.

Although the detector and method according to one embodiment of the present invention will be described in connection with a security system, it should be recognized that the application of the detector and method according to the present invention is not limited to a security system. Rather, the detector and method are applicable to any other suitable circumstances.

BRIEF DESCRIPTION OF THE DRAWINGS

These and other features, benefits, and advantages of the present invention will become apparent by reference to the following text and figures, with like reference numbers referring to like structures across the view, wherein.

DETAILED DESCRIPTION OF THE INVENTION

The present invention now will be described in detail hereinafter with reference to the accompanying drawings, in which exemplary embodiments of the invention are shown. However, this invention may be embodied in many different forms and should not be construed as limited to the embodiments set forth herein. Like numerals refer to like elements throughout.

Figure 1:
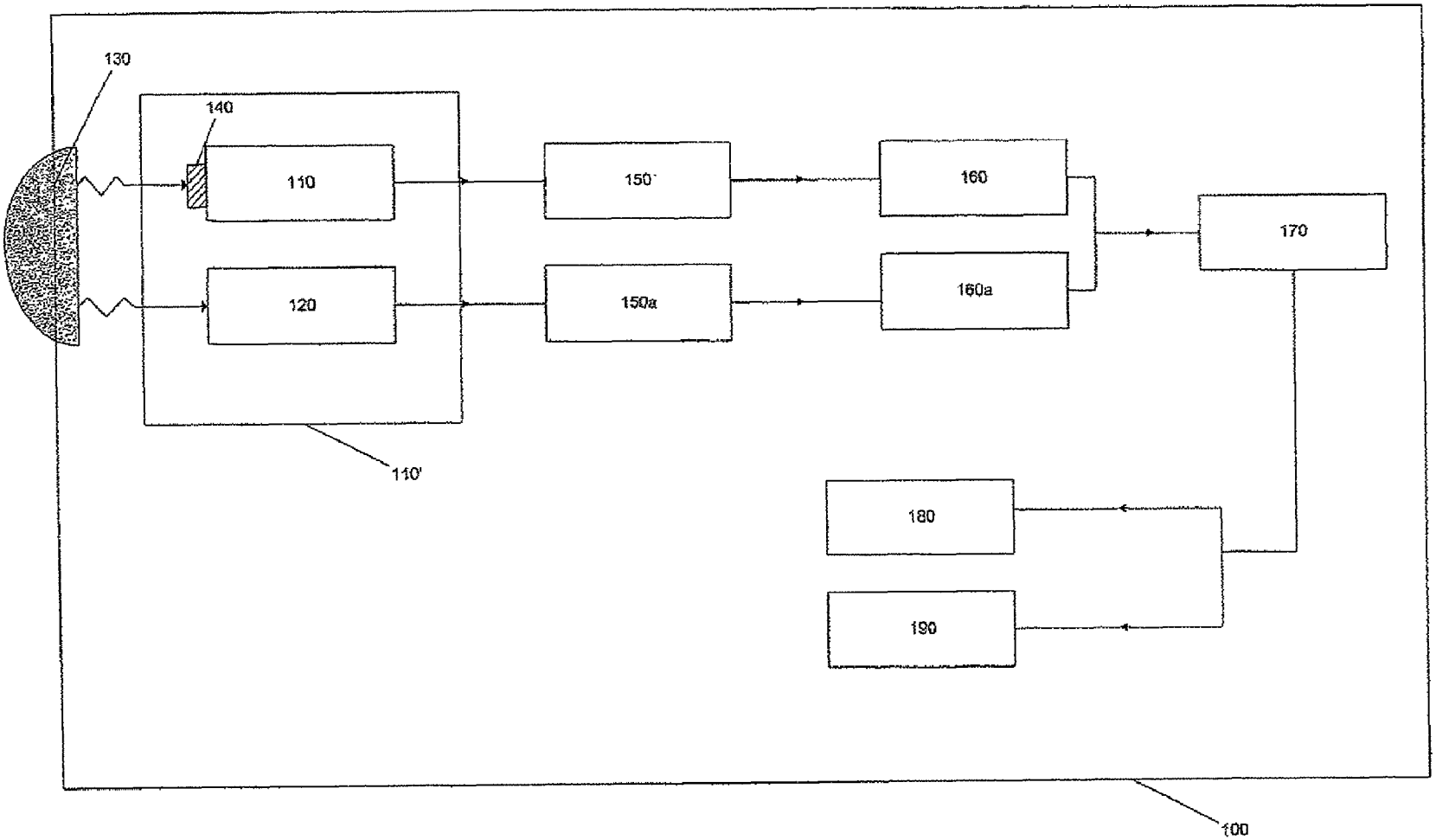
FIG. 1 is a block diagram of a motion detector in accordance with an exemplary embodiment of the invention.

FIG. 1 illustrates a block diagram of a motion detector 100 according to one exemplary embodiment of the present invention. Generally, the motion detection system 100 includes a pyroelectric sensor 110 containing an optical filter 112, a vibration sensor 120, a lens 130, a first signal amplifier 150 and a second signal amplifier 150*a*, a first signal filter 160 and a second signal filter 160*a*, and a processing unit 170. Additionally, the motion detector 100 includes an alarm relay 180 which signals to the control panel when a human is detected. When the control panel is armed, the panel will take measures, such as sounding an alarm, turning on one or more lights and/or notifying the police when an alarm signal is generated. The motion detector 100 also contains a tamper relay 180*a* used to generate a signal when the detector unit has been tampered with. In the exemplary embodiment of the present invention, the processor 170 leaves this relay activated until the tamper condition has been removed and the motion detector 100 has been verified to once again have the ability to detect a human in the protected area. Additionally, the motion detector 100 includes a status indicator 190 for showing the operational status of the motion detector 100. Additionally, the motion detector 100 will include a power source (not shown). The power source can be an internal power source such as a battery.

In accordance with the embodiment of the present invention, the motion detector 100 is adapted to detect a tampering of the motion detector 100. The motion detector 100 is capable of detecting either a spraying or brushing of a coating on the lens 130 where the spraying or brushing prevents an accurate detection of motion. Generally, the motion detector 100 examines or analyzes a parameter in connection with the vibration associated with the detector tampering, to determine the presence of a tampering act in the detection zone and, in addition, the type of the tampering act, such as a brushing or a spraying.

The lens 130, for example, a Fresnel lens array or window used in conjunction with a mirror array, is disposed in front of the pyroelectric sensor 110 to focus and transmit the light energy onto the sensor. For example, a Fresnel lens array can be molded externally and assembled in the housing (not shown) of the motion detection 100 to implement the lens 130. The lens 130 can be multi-faceted in order to provide a plurality of detection zones, which can fanned out in a vertical orientation as well as horizontal orientation to maximize the coverage of the detection system.

The lens 130 can also be configured to inhibit the passage of light having predetermined wavelengths, and thereby can function as a light filtering element. The infrared energy or signal will reach the pyroelectric sensor only through the lens 130. Thus, if the lens is sprayed or brushed with a coating, an infrared signal will not pass through. In an exemplary embodiment of the pyroelectric sensor 110, the filter 112 is configured to filter out as much as possible the visible light passing through the lens 130 and attenuate as little as possible the infrared light passing through the lens 130.

The pyroelectric sensor 110 is responsive to changes in infrared light emanating from objects entering or exiting a detection zone. The pyroelectric sensor 110 converts the changes in infrared light into electrical signals. Motion is detected when an infrared emitting source with one temperature, such as a human body passes in front of a source (background) with another temperature. Motion is detected based on the difference in temperature.

The pyroelectric sensor 110 generates a light output signal representative of a detected parameter of the infrared light, such as the change of the intensity level of infrared light. If the level of the infrared light increases beyond a threshold level, it is determined that an intruder is present in the detection zone, and subsequently an alarm is issued. For example, the output signal from the pyroelectric sensor 110 is in the form of a voltage change. Preferably, the detector 100 includes a first signal amplifier 150 and a first signal filter 160 to amplify and filter the voltage change before the signal is inputted to the processing unit 170.

The vibration sensor 120 can be any suitable sensor that is capable of sensing the vibrations applied on the detector, especially on the lens 130 of the detector. By incorporating such a vibration-sensitive sensor into the detector, the detector can "hear" the applications of masking materials on the lens. The vibration sensor 120 includes, but is not limited to, an acoustic sensor, such as a microphone or piezo-transducer. The vibration sensor 120 is able to sense the vibrations conducted by air or by a solid. In one embodiment, the vibration sensor 120 includes an electret microphone, which is very sensitive to solid-conducted sound caused by a spraying or a brushing on the lens of the detector. In addition, the vibration sensor 120 may include but is not limited to any type of suitable microphone and/or an accelerometer.

The vibration sensor 120 can be disposed at any location relative to the detector as long as the sensor can sense the vibrations applied on the lens. In one embodiment, the vibration sensor 120 is embedded in a solid component of the detector, such as mounted on the surface of the PCB of the detector, thereby detecting the sound radiated through the air as well as conducted through the housing to the PCB.

The vibration sensor 120 senses vibrations and generates a vibration output signal representative of detected parameters of the vibrations. For example, the vibration sensor 120 generates a signal according to the amplitude, intensity and/or frequency of the vibrations applied to the lens of the detector. For example, the signal is in the form a voltage change. In one embodiment, the detector 100 includes a second signal amplifier 150*a* and a second signal filter 160*a* to amplify and filter the voltage change before the signal is sent to the processing unit 170.

Generally, different types of tampering illustrate different sound patterns, that can be utilized to not only determine the presence of a tampering act but determine the type the tampering act.

For example, output signals caused by a spraying illustrate different characteristics than output signals caused by a brushing. Thus, a model indicative of a specific tampering act can be generated accordingly. Experimentation can be performed to set up an alarm threshold associated with a specific tampering act, such as a spraying. A plurality of thresholds can be generated empirically or statistically for identifying different tampering acts. If it is determined that the output signal caused by a possible tampering act exceeds a predetermined threshold, a tampering alarm is issued and accordingly the type of the tampering act is identified. For example, models can be created for detecting and identifying a spraying, a brushing or an application of clear tapes. The models are stored in a storage, which is accessible by the processing unit 170.

In one embodiment, the pyroelectric sensor 110 and the vibration sensor 120 are integrated into a unitary section 110', as shown by the phantom line in FIG. 1. The unitary section 110' performs the sensing of infrared light as well as vibration and generates an output signal, which can be representative of either infrared light or sound. In this case, the signal is processed for detecting motion and a tampering by two different channels implemented by two different sets of amplifiers and filters. Moreover, the unitary section 110' can be made of materials inherent with pyroelectric-effect and piezoelectric-effect, such as a pyroelectric sensor sensitive to vibrations as well.

Figure 2:
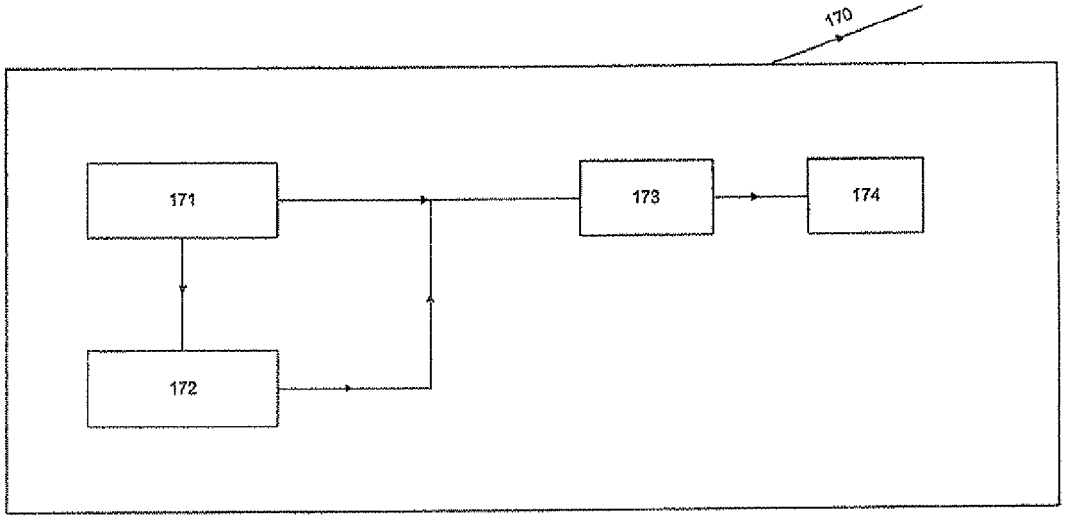
FIG. 2 illustrates a block diagram of a processing unit of a motion detector in accordance with an exemplary embodiment of the invention.

FIG. 2 is a block diagram of functional blocks in a processing unit in accordance with an embodiment of the invention. The processing unit can be any computer-related entity as long as it is capable of executing the functionality thereof. For example, the component includes but is not limited to hardware, software and a combination of hardware and software.

As depicted in FIG. 2, the processing unit 170 includes a signal receiving element 171, a data reading element 172, a logic comparing element 173 and an activating signal generating element 174.

The signal receiving element 171 receives the output signal from the pyroelectric sensor 110 and/or the vibration sensor 120, and further feeds the signal to the logic comparing element 173 and the data reading element 172. The signal inputted into the data reading element 172 is used to determine which model(s) stored in a storage (not shown) shall be read out and further fed to the logic comparing element 173. The storage includes all preset models and thresholds, including but not limited to, rate of change, duration, amplitudes and so on. The storage can be any type of memory.

For example, if it is determined by the data reading element 172 that the input signal is indicative of the change of intensity level of infrared light, the data reading element 172 reads out a model in connection with the light output signal, such as a threshold for the infrared light, and feeds the threshold into the logic comparing element 173. Otherwise, the data reading element 172 reads out the models in connection with the vibration output signal, such as thresholds indicative of a brushing, a spraying, an application of clear tapes, and so on, and feeds the thresholds into the logic comparing element 173.

The logic comparing element 173 compares the inputted signal from the signal receiving element 171 with the thresholds inputted from the data reading element 172, to determine whether the signal exceeds a predetermined threshold. If the signal exceeds a predetermined threshold, the logic comparing element 173 transmits an instruction to the activating signal generating element 174, for generating an activating signal identifying a motion or a tampering act, and, if a tampering act is detected, the type of tampering act. The alarm relay 180, shown in FIG. 1, is responsive to the motion activating signal and issues an alarm signal to the panel accordingly. The tamper relay 180*a*, shown in FIG. 1, is responsive to the tamper activating signal and issues tamper signal to the panel accordingly.

Figure 3:
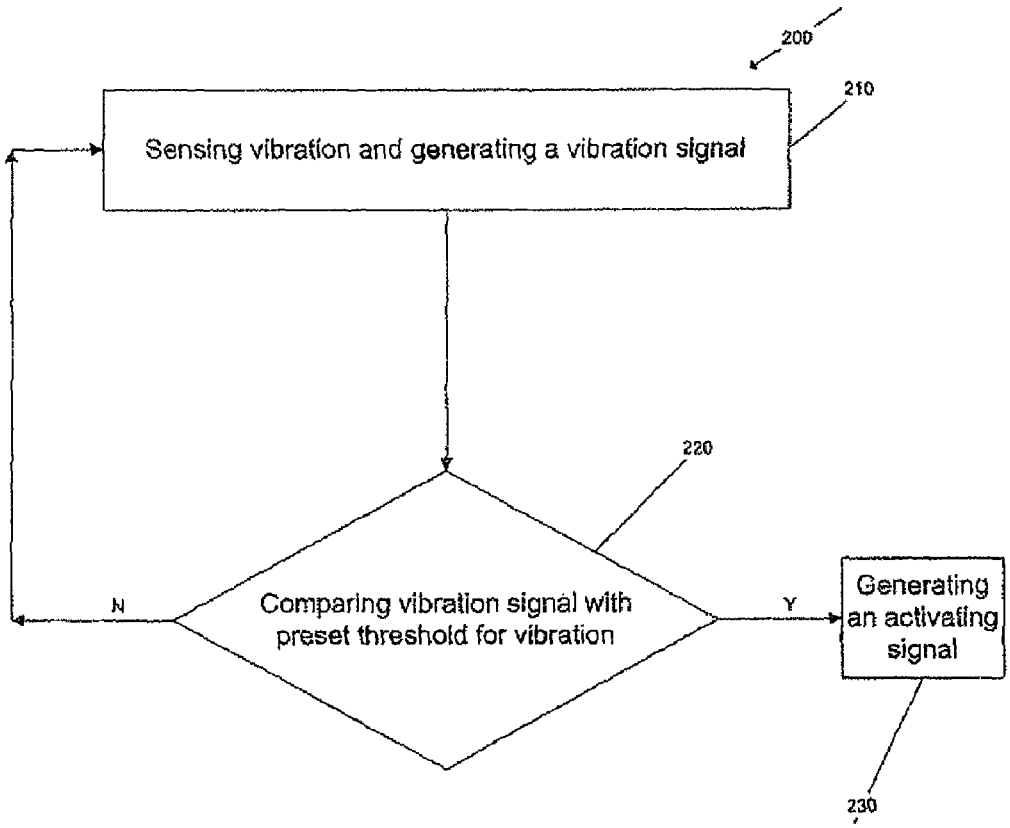
FIG. 3 illustrates a flow chart for a tampering detection method in accordance with an exemplary embodiment of the invention.

FIG. 3 illustrates a flow chart for a method 200 for detecting tampering, according to an exemplary embodiment of the invention.

At step 210, vibrations applied to the lens of the detector are detected and accordingly a vibration output signal representative of a detected level of the vibration is produced by the vibration sensor 120 shown in FIG. 1. For example, the vibrations output signal is in the form a voltage change, which reflects the vibrations applied on the lens of the detector. Optionally, the method 200 includes steps of amplifying and filtering the output signal generated in steps 210. Preferably, the signals are digitized before being processed.

At step 220, it is determined whether the vibration output signal is consistent with a predetermined model indicative of a tampering. At step 220, the vibration output signal is compared with a threshold and waveform retrieved from a storage. If it is determined that the vibrations output signal is consistent with the waveform and exceeds the threshold, an activating signal is produced at step 230, which is transmitted to tamper relay for issuing a tampering alarm. On the other hand, if it is determined that the vibrations output signal does not exceed the threshold or is inconsistent with the waveform, the method returns to step 210.

The invention has been described herein with reference to particular exemplary embodiments. Certain alterations and modifications may be apparent to those skilled in the art, without departing from the scope of the invention. The exemplary embodiments are meant to be illustrative, not limiting of the scope of the invention, which is defined by the appended claims.

What is claimed is:

1. A motion detector for detecting a tampering of the motion detector, comprising:

a lens;

a vibration-sensing unit sensitive to vibrations applied to the detector lens and producing a vibration output signal representative of a detected parameter of the vibrations;

an infrared light-sensing unit sensitive to infrared light in a predetermined spectrum and producing a light output signal representative of a detected parameter of the light in the predetermined spectrum; and a processing unit for determining if the vibration output signal is consistent with a predetermined model indicative of a tampering and producing an activating signal accordingly.

2. The detector of claim 1, further comprising a signal amplifier for amplifying the vibration output signal and a signal filter for filtering the vibration output signal.

3. The detector of claim 1, wherein the detected parameter of the vibrations comprises at least one of frequency, amplitude and intensity of the vibrations.

4. The detector of claim 1, wherein the vibration-sensing unit and the light-sensing unit are integrated into a unitary section, which is made of materials inherent with pyroelectric-effect and piezoelectric-effect.

5. The detector of claim 4, wherein the unitary section is a pyroelectric sensor responsive to infrared light and vibration.

6. The detector of claim 1, wherein the vibration sensing unit is selected from the group consisting of a piezo-electric transducer, an electret microphone, any type of microphone and an accelerometer.

7. The detector of claim 1, wherein the light-sensing unit is a pyroelectric sensor sensitive to light in the infrared spectrum.

8. The detector of claim 1, wherein the predetermined model indicative of a tampering comprises a tampering pattern indicative of a spraying, the tampering pattern comprises a tampering alarm threshold empirically generated and indicative of a spraying, and the processing unit compares the vibration output signal with the tampering alarm threshold and produces an activating signal indicating a spraying if the vibration output signal exceeds the threshold.

9. The detector of claim 1, wherein the predetermined model indicative of a tampering comprises a tampering pattern indicative of a brushing, the tampering pattern comprises a tampering alarm threshold empirically generated and indicative of a brushing, and the processing unit compares the vibration output signal with the tampering alarm threshold and produces an activating signal indicating a brushing if the vibration output signal exceeds the threshold.

10. The detector of claim 1, wherein the predetermined model indicative of a tampering comprises a tampering pattern indicative of an application of a film onto lens of the detector, the tampering pattern comprises a tampering alarm threshold empirically generated and indicative of an application of a film on the lens of the detector, and the processing unit compares the vibration output signal with the tampering alarm threshold and produces an activating signal indicating an application of a film onto the lens if the vibration output signal exceeds the threshold.

11. The detector of claim 1, further comprising at least one lens or window that is transmissive or reflective of the wavelength in the visible or near infrared and an active visible or near infrared sensing unit for detecting presence of or application of mask materials in the vicinity of the lens or window.

12. The detector of claim 1, further comprising a microwave sensing unit for detecting the presence of or application of materials that block far IR energy.

13. A method of detecting a tampering of a motion detector, comprising the steps of:

providing a lens;

sensing vibrations applied to the lens and producing a vibration output signal representative of a detected level of the vibration; and determining if the vibration output signal is consistent with a predetermined model indicative of a tampering and producing an activating signal accordingly.

14. The method of claim 13, wherein producing a vibration output signal representative of a detected level of the vibration comprises producing a vibration output signal representative of at least one of frequency, amplitude and intensity of the vibrations.

15. The method of claim 13, wherein determining if the vibration output signal is consistent with a predetermined model indicative of a tampering and producing an activating signal accordingly comprises determining if the vibration output signal is consistent with a tampering pattern indicative of a spraying and producing an activating signal indicating a spraying accordingly.

* * * * *